US009392843B2

(12) United States Patent
Callahan et al.

(10) Patent No.: US 9,392,843 B2
(45) **Date of Patent: *Jul. 19, 2016**

(54) ARTICLE OF FOOTWEAR HAVING AN UNDULATING SOLE

(75) Inventors: Erica Callahan, Medford, MA (US); Matthew Montross, Middleboro, MA (US); Henry Hardigan, Pawtucket, RI (US); Ricardo Vestuti, Providence, RI (US)

(73) Assignee: Reebok International Limited, London (GB)

( * ) Notice: Subject to any disclaimer, the term of this patent is extended or adjusted under 35 U.S.C. 154(b) by 531 days.

This patent is subject to a terminal disclaimer.

(21) Appl. No.: 12/506,957

(22) Filed: Jul. 21, 2009

(65) Prior Publication Data

US 2011/0016746 A1 Jan. 27, 2011

(51) Int. Cl.

| | |
|---|---|
| ***A43B 1/10*** | (2006.01) |
| ***A43B 5/00*** | (2006.01) |
| ***A43B 13/00*** | (2006.01) |
| ***A43B 13/14*** | (2006.01) |
| ***A43B 13/18*** | (2006.01) |
| ***A43B 3/00*** | (2006.01) |

(52) U.S. Cl.

CPC ..... *A43B 13/181* (2013.01); *A43B 3/0057* (2013.01); *A43B 3/0068* (2013.01); *A43B 13/141* (2013.01); *A43B 13/187* (2013.01)

(58) Field of Classification Search

CPC ..... A43B 13/00; A43B 13/14; A43B 13/12; A43B 13/18; A43B 13/183; A43B 13/141; A43B 13/206; A43B 13/181; A43B 13/184; A43B 13/187; A43B 13/145; A43B 13/146; A43B 13/186; A43B 13/223; A43B 3/0057; A43B 3/0063; A43B 3/0068

USPC ..... 36/102, 103, 25 R, 27, 28, 29, 31, 35, 36/35 R, 35 B, 59 C

See application file for complete search history.

(56) References Cited

U.S. PATENT DOCUMENTS

| | | | |
|---|---|---|---|
| 485,459 | A | 11/1892 | Crocker |
| 1,594,056 | A | 7/1926 | Floyd |
| 1,607,375 | A | 11/1926 | Whipple |
| D108,320 | S | 2/1938 | Eldon |

(Continued)

FOREIGN PATENT DOCUMENTS

| | | | | |
|---|---|---|---|---|
| DE | 1145961 | | 3/1963 | |
| DE | 2816619 | A1 * | 10/1979 | ..... A43B 13/20 |

(Continued)

OTHER PUBLICATIONS

U.S. Appl. No. 29/405,483, Erica Callahan, "Portion of a Shoe", filed Nov. 2, 2011.

(Continued)

*Primary Examiner* — Alissa L Hoey
*Assistant Examiner* — Jameson Collier
(74) *Attorney, Agent, or Firm* — Sterne, Kessler, Goldstein & Fox P.L.L.C.

(57) ABSTRACT

An article of footwear with an undulating sole provides a different and unique ride and/or feel to the article of footwear, while also providing a unique aesthetic appeal and adequate cushioning and support. The midsole has an undulating shape substantially similar to a sine wave with a series of alternating peaks and troughs.

14 Claims, 19 Drawing Sheets

(56) References Cited

U.S. PATENT DOCUMENTS

D133,176 S 7/1942 Gregg
D136,381 S 9/1943 Ghez et al.
D149,139 S 3/1948 Parker
D157,034 S 1/1950 Eldon
2,553,616 A * 5/1951 Walls ..... A43B 13/20 36/29
2,580,840 A 1/1952 Rogndal
2,627,676 A * 2/1953 Hack ..... 36/29
D173,030 S 9/1954 Hoza
2,710,461 A * 6/1955 Hack ..... 36/28
2,722,756 A 11/1955 Ecclesine
3,005,272 A * 10/1961 Shelare et al. ..... 36/29
3,087,262 A 4/1963 Russell
3,444,632 A 5/1969 Hack et al.
3,717,943 A 2/1973 Orndorff, Jr.
D233,805 S 12/1974 Kubo
4,071,963 A * 2/1978 Fukuoka ..... 36/3 B
4,130,947 A 12/1978 Oenu
4,170,078 A * 10/1979 Moss ..... 36/28
D274,574 S 7/1984 Stubblefield
4,507,879 A * 4/1985 Dassler ..... A43B 5/02 36/102
4,536,974 A * 8/1985 Cohen ..... 36/28
4,561,195 A 12/1985 Onoda et al.
4,611,412 A * 9/1986 Cohen ..... 36/28
4,642,917 A 2/1987 Ungar
D296,149 S 6/1988 Diaz
4,798,010 A 1/1989 Sugiyama
4,805,319 A 2/1989 Tonkel
4,864,737 A 9/1989 Marrello
D316,324 S 4/1991 Rogers
5,044,096 A 9/1991 Polegato
D324,131 S 2/1992 Lucas
D325,288 S 4/1992 Richard et al.
D326,014 S 5/1992 Issler
D327,362 S 6/1992 Hartfield
D334,282 S 3/1993 Greene
D336,771 S 6/1993 Harfield et al.
D347,516 S 6/1994 Foster
5,319,866 A 6/1994 Foley et al.
5,337,492 A 8/1994 Anderie et al.
D356,206 S 3/1995 Martin
D357,346 S 4/1995 Ho
D360,065 S 7/1995 Werman
5,461,800 A * 10/1995 Luthi et al. ..... 36/28
D364,497 S 11/1995 Schelling
5,469,639 A 11/1995 Sessa
D367,952 S 3/1996 Shea
D378,011 S 2/1997 Lucas
D379,259 S 5/1997 Kayano
D385,987 S 11/1997 Bramani
D390,346 S 2/1998 Loveder
5,713,140 A 2/1998 Baggenstoss
D394,945 S 6/1998 Doxey
D395,739 S 7/1998 Mervar
D396,947 S 8/1998 Serna
D397,847 S 9/1998 Hudson
5,799,415 A 9/1998 Kenji et al.
5,822,886 A * 10/1998 Luthi et al. ..... 36/28
D402,455 S 12/1998 Greenberg
D412,236 S 7/1999 von Contal
5,918,385 A * 7/1999 Sessa ..... 36/59 C
D414,316 S 9/1999 Lozano
D415,610 S 10/1999 Cahill
5,987,782 A * 11/1999 Bramani ..... 36/107
6,009,637 A 1/2000 Pavone
D420,497 S 2/2000 Panella
D421,834 S 3/2000 Cooper
D424,287 S 5/2000 Edwards
6,079,125 A 6/2000 Quellais et al.
6,108,943 A 8/2000 Hudson et al.
6,138,385 A 10/2000 Jungkind et al.
6,189,239 B1 2/2001 Gasparovic et al.
6,205,681 B1 3/2001 Kita
6,219,939 B1 4/2001 Kita et al.
6,219,940 B1 4/2001 Kita
D442,357 S 5/2001 Burt
6,226,896 B1 5/2001 Friton
6,289,608 B1 9/2001 Kita et al.
D449,433 S 10/2001 Matis et al.
6,295,741 B1 10/2001 Kita
6,305,100 B1 10/2001 Komarnycky et al.
6,311,414 B1 11/2001 Kita
6,314,664 B1 11/2001 Kita et al.
6,338,206 B1 1/2002 Kita
6,389,713 B1 5/2002 Kita
6,393,732 B1 5/2002 Kita
6,401,365 B2 6/2002 Kita et al.
D465,079 S 11/2002 Merceron
6,516,539 B2 2/2003 Nishiwaki et al.
6,557,270 B2 5/2003 Nakano et al.
D475,509 S 6/2003 Avar
6,606,804 B2 8/2003 Kaneko et al.
6,625,905 B2 9/2003 Kita
6,647,645 B2 11/2003 Kita
6,675,500 B1 1/2004 Cadamuro
6,685,011 B2 2/2004 Nishiwaki et al.
6,694,642 B2 2/2004 Turner
6,711,834 B1 3/2004 Kita
D489,525 S 5/2004 Snow et al.
D489,881 S 5/2004 Recchi
D490,599 S 6/2004 Snow et al.
6,754,981 B1 6/2004 Edwards
6,763,611 B1 7/2004 Fusco
D495,128 S 8/2004 Avar
D497,046 S 10/2004 Scott
6,810,605 B2 11/2004 Nakano et al.
D499,247 S 12/2004 Wahoske et al.
6,964,119 B2 11/2005 Weaver, III
D515,305 S 2/2006 Andrews-Kramer
D515,306 S 2/2006 Andrews-Kramer
D516,293 S 3/2006 Smith, III
D523,232 S 6/2006 Shaffer
D523,614 S 6/2006 Mitchell
D523,627 S 6/2006 Avar
D523,628 S 6/2006 Young
7,055,198 B2 6/2006 Cadamuro et al.
D524,034 S 7/2006 Hlavacs
D524,035 S 7/2006 Greene et al.
D524,535 S 7/2006 Cass
7,089,152 B2 8/2006 Oda et al.
D528,753 S 9/2006 Dirsa
D528,776 S 9/2006 Hui
D528,778 S 9/2006 Avar et al.
D529,267 S 10/2006 Portzline
D530,905 S 10/2006 Jonsson
D532,597 S 11/2006 Chan
7,162,815 B2 1/2007 Miyauchi et al.
D537,611 S 3/2007 Matis et al.
D546,532 S 7/2007 Matis et al.
D552,832 S 10/2007 Hardy
D553,837 S 10/2007 Hubbard
D553,846 S 10/2007 Kayano et al.
D555,348 S 11/2007 Bettencourt
D555,891 S 11/2007 Bettencourt et al.
D560,061 S 1/2008 Chan
D560,062 S 1/2008 Chan
D560,063 S 1/2008 Chan
D561,958 S 2/2008 Hahn
D561,985 S 2/2008 Andersen et al.
7,334,349 B2 * 2/2008 Sokolowski et al. ..... 36/25 R
7,337,559 B2 3/2008 Russell
D569,594 S 5/2008 Horne et al.
D569,595 S 5/2008 Le
D570,078 S 6/2008 Davis
D574,141 S 8/2008 Kaufman
D574,581 S 8/2008 Cooper
D574,583 S 8/2008 St-Louis et al.
D574,602 S 8/2008 Grenet
D574,603 S 8/2008 McMillan
D574,604 S 8/2008 McMillan
D576,394 S 9/2008 Heller
D578,744 S 10/2008 Earle
7,441,346 B2 10/2008 Hardy et al.

(56) References Cited

U.S. PATENT DOCUMENTS

| | | | |
|---|---|---|---|
| D584,490 | S | 1/2009 | Ong |
| D586,991 | S | 2/2009 | Fuerst |
| D586,993 | S | 2/2009 | Banik et al. |
| D592,383 | S | 5/2009 | Wawrousek |
| D592,847 | S | 5/2009 | Rosenbaum |
| D594,195 | S | 6/2009 | Nakano |
| 7,549,236 | B2 | 6/2009 | Dillon et al. |
| D595,937 | S | 7/2009 | Morris |
| D596,386 | S | 7/2009 | Brambilla |
| 7,556,846 | B2 | 7/2009 | Dojan et al. |
| D599,986 | S | 9/2009 | Reiss |
| D600,895 | S | 9/2009 | Morgm |
| D601,334 | S | 10/2009 | Werman |
| D605,838 | S | 12/2009 | Foust |
| D607,193 | S | 1/2010 | Recchi |
| D607,633 | S | 1/2010 | Mongelli |
| 7,644,518 | B2 | 1/2010 | Chandler et al. |
| D609,440 | S | 2/2010 | Morris |
| D609,441 | S | 2/2010 | Wawrousek |
| D615,286 | S | 5/2010 | Grote |
| D615,741 | S | 5/2010 | Matis et al. |
| D616,188 | S | 5/2010 | Chan |
| 7,707,743 | B2 | 5/2010 | Schindler |
| D617,085 | S | 6/2010 | Recchi et al. |
| D617,983 | S | 6/2010 | Raysse |
| 7,762,008 | B1 | 7/2010 | Clark et al. |
| D622,043 | S | 8/2010 | Hauglin |
| 7,784,196 | B1 | 8/2010 | Christensen et al. |
| D624,293 | S | 9/2010 | Recchi et al. |
| D634,922 | S | 3/2011 | Pauk et al. |
| D636,567 | S | 4/2011 | Raysse |
| D637,380 | S | 5/2011 | Niedner et al. |
| 7,946,058 | B2 | 5/2011 | Johnson et al. |
| D641,143 | S | 7/2011 | Niedner et al. |
| D641,545 | S | 7/2011 | Niedner et al. |
| D642,776 | S | 8/2011 | Raysse |
| D643,194 | S | 8/2011 | Raysse |
| D644,419 | S | 9/2011 | Raysse |
| D644,420 | S | 9/2011 | Christopherson |
| D644,824 | S | 9/2011 | Leleu |
| D646,871 | S | 10/2011 | Christopherson |
| 8,056,264 | B2 | 11/2011 | Sato et al. |
| D649,753 | S | 12/2011 | Callahan et al. |
| D649,754 | S | 12/2011 | Callahan et al. |
| D652,201 | S | 1/2012 | Vestuti et al. |
| D653,842 | S | 2/2012 | Weiss |
| 8,112,905 | B2 * | 2/2012 | Bemis et al. ..... 36/27 |
| D655,483 | S | 3/2012 | Portzline |
| D655,487 | S | 3/2012 | Blakeslee |
| D655,489 | S | 3/2012 | Mahoney |
| D655,897 | S | 3/2012 | Mahoney |
| D655,902 | S | 3/2012 | Debiase |
| D656,715 | S | 4/2012 | Katz et al. |
| D656,720 | S | 4/2012 | Wawrousek |
| D657,542 | S | 4/2012 | Duan |
| D657,944 | S | 4/2012 | Casadei |
| 8,146,266 | B2 | 4/2012 | Vattes et al. |
| D659,356 | S | 5/2012 | Van Zyll De Jong et al. |
| D659,362 | S | 5/2012 | Van Zyll De Jong et al. |
| D659,958 | S | 5/2012 | Birkinhead |
| D659,959 | S | 5/2012 | Vestuti et al. |
| D659,964 | S | 5/2012 | Callahan et al. |
| D659,965 | S | 5/2012 | Callahan et al. |
| D660,568 | S | 5/2012 | Blakeslee |
| 8,181,365 | B2 | 5/2012 | Cass et al. |
| D661,476 | S | 6/2012 | Loverin |
| D661,879 | S | 6/2012 | Raysse |
| D661,880 | S | 6/2012 | Raysse |
| D662,293 | S | 6/2012 | Christopherson |
| D662,295 | S | 6/2012 | Raysse |
| D662,301 | S | 6/2012 | Raysse |
| D662,697 | S | 7/2012 | Portzline |
| D662,699 | S | 7/2012 | Callahan et al. |
| D662,700 | S | 7/2012 | Raysse |
| D663,929 | S | 7/2012 | Teng-Lee |
| D666,390 | S | 9/2012 | Van Zyll De Jong et al. |
| D667,204 | S | 9/2012 | Campbell et al. |
| D667,617 | S | 9/2012 | Spring |
| D667,618 | S | 9/2012 | Raysse |
| D667,619 | S | 9/2012 | Blakeslee |
| D668,028 | S | 10/2012 | Pope |
| D668,029 | S | 10/2012 | Vestuti et al. |
| D669,255 | S | 10/2012 | Birkenhead |
| D674,581 | S | 1/2013 | Callahan et al. |
| D674,996 | S | 1/2013 | Sallee |
| D674,997 | S | 1/2013 | Callahan et al. |
| D675,003 | S | 1/2013 | Leon et al. |
| 2001/0008053 | A1 | 7/2001 | Belli |
| 2003/0101621 | A1 | 6/2003 | Nishiwaki et al. |
| 2004/0154189 | A1 | 8/2004 | Wang |
| 2006/0137227 | A1 | 6/2006 | Kita et al. |
| 2006/0277792 | A1 | 12/2006 | Schoenborn |
| 2006/0283045 | A1 | 12/2006 | Kita et al. |
| 2007/0033837 | A1 * | 2/2007 | Fulton ..... 36/59 R |
| 2007/0209230 | A1 | 9/2007 | Dillon et al. |
| 2007/0266593 | A1 * | 11/2007 | Schindler et al. ..... 36/28 |
| 2008/0052965 | A1 | 3/2008 | Sato |
| 2008/0066347 | A1 | 3/2008 | Suzuki |
| 2008/0120871 | A1 * | 5/2008 | Sato et al. ..... 36/88 |
| 2008/0229617 | A1 | 9/2008 | Johnson et al. |
| 2008/0276491 | A1 * | 11/2008 | Gaensler et al. ..... 36/28 |
| 2008/0289224 | A1 * | 11/2008 | Sink ..... 36/103 |
| 2009/0013559 | A1 | 1/2009 | Chan et al. |
| 2010/0175280 | A1 | 7/2010 | Rinehart, Jr. et al. |
| 2010/0192420 | A1 | 8/2010 | Favraud |
| 2010/0269376 | A1 | 10/2010 | Flannery et al. |
| 2010/0325917 | A1 | 12/2010 | Cass et al. |
| 2011/0016746 | A1 | 1/2011 | Callahan et al. |
| 2011/0016749 | A1 | 1/2011 | Callahan et al. |
| 2011/0232130 | A1 | 9/2011 | Boudreau et al. |
| 2011/0277351 | A1 | 11/2011 | Scoledes |
| 2011/0289799 | A1 | 12/2011 | Keating et al. |
| 2012/0000095 | A1 | 1/2012 | Torrance |
| 2012/0055047 | A1 | 3/2012 | Youngs |
| 2012/0073160 | A1 | 3/2012 | Marvin et al. |

FOREIGN PATENT DOCUMENTS

| | | | | |
|---|---|---|---|---|
| EP | 1064861 | A | 1/2001 | |
| JP | 05309001 | A * | 11/1993 | |
| JP | 11000203 | A | 1/1999 | |
| JP | 11235202 | A | 8/1999 | |
| JP | 2001275711 | A | 10/2001 | |
| JP | 2002336003 | A | 11/2002 | |
| JP | 2003339405 | A | 12/2003 | |
| JP | 2004173884 | A | 6/2004 | |
| JP | 2004267516 | A | 9/2004 | |
| JP | 2005253578 | A | 9/2005 | |
| WO | WO 8101234 | A1 * | 5/1981 | ..... A43B 13/18 |
| WO | WO 2004028285 | A1 * | 4/2004 | ..... A43B 13/18 |

OTHER PUBLICATIONS

U.S. Appl. No. 29/405,484, Erica Callahan, "Portion of a Shoe", filed Nov. 2, 2011.

U.S. Appl. No. 29/408,163, Ricardo Vestuti, "Shoe and Portion of a Shoe", filed Dec. 7, 2011.

U.S. Appl. No. 12/980,961, Brian Christenson, "Sole and Article of Footwear", filed Dec. 29, 2010.

K-Swiss, Inc. Online Store—Tubes Run 100A, http://www.kswiss.com/item/201.200/02316-162/Men/Footwear_Running/Tubes_Run_100_A/Wht_Blk_Sunorng.html (visited on Oct. 2, 2009), 1 page.

Office Action dated Aug. 12, 2011 from U.S. Appl. No. 29/362,605, Vestuti et al., Shoe and Portion of Shoe, filed May 27, 20010.

Office Action dated Sep. 13, 2011 from U.S. Appl. No. 29/345,964, Pope, Portion of a Shoe, filed Oct. 23, 2009.

Adidas Q2 2007 Footwear Catalog, p. 5, showing the T 7 ATS shoe, and p. 122, showing the J S3 W shoe.

U.S. Appl. No. 12/748,246, Matthew Boudreau, "Article of Footwear with Support Element", filed Mar. 26, 2010.

U.S. Appl. No. 12/832,464, Erica Callahan, "Article of Footwear and Methods of Making Same", filed Jul. 8, 2010.

(56) References Cited

OTHER PUBLICATIONS

U.S. Appl. No. 29/342,098, Erica Callahan, "Shoe Sole and Portion of a Shoe Sole", filed Aug. 8, 2009.
U.S. Appl. No. 29/345,964, Christopher S. Pope, "Shoe and Portion of a Shoe", filed Oct. 23, 2009.
U.S. Appl. No. 29/353,673, Erica Callahan, "Portion of a Shoe Sole", filed Jan. 12, 2010.
U.S. Appl. No. 29/362,605, Ricardo Vestuti, "Shoe and Portion of a Shoe", filed May 27, 2010.
U.S. Appl. No. 29/375,659, Toby Birkinhead, "Portion of a Shoe", filed Sep. 24, 2010.
Extended European Search Report for Application No. EP 11194626.5, Applicant: Reebok International Limited, mailed May 8, 2012, 6 pages.
U.S. Appl. No. 29/411,762, Hardigan et al., "Portion of a Shoe Sole", filed Jan. 25, 2012.
U.S. Appl. No. 29/416,617, Davis et al., "Portion of a Shoe", filed Mar. 23, 2012.
U.S. Appl. No. 13/428,897, Davis et al., "Articles of Footwear", filed Mar. 23, 2012.
U.S. Appl. No. 29/418,772, Vestuti et al., "Portion of a Shoe", filed Apr. 30, 2012.
U.S. Appl. No. 29/419,638, Birkinhead, "Portion of a Shoe", filed Apr. 30, 2012.
U.S. Appl. No. 29/419,900, Callahan et al., "Portion of a Shoe", filed May 2, 2012.
U.S. Appl. No. 29/419,905, Callahan et al., "Portion of a Shoe", filed May 2, 2012.
Office Action dated Apr. 25, 2012 from U.S. Appl. No. 12/832,464, Callahan et al., Article of Footwear and Methods of Making Same, filed Jul. 8, 2010.
U.S. Appl. No. 29/443,384, Callahan, "Shoe Sole", filed Jan. 16, 2013.
Office Action dated May 17, 2013 from U.S. Appl. No. 12/748,246, Boudreau et al., Article of Footwear with Support Element, filed Mar. 26, 2010.
Office Action dated May 29, 2013 from U.S. Appl. No. 12/832,464, Callahan et al., Article of Footwear and Methods of Making Same, filed Jul. 8, 2010.
Partial European Search Report for Appl. No. EP 10170301.5, European Patent Office, Munich, Germany, mailing date of Feb. 6, 2015, 13 pages.
Partial European Search Report for Application No. EP 10170301.5, European Patent Office, Munich, Germany, dated Sep. 29, 2014, 7 pages.

* cited by examiner

ARTICLE OF FOOTWEAR HAVING AN UNDULATING SOLE

BACKGROUND OF THE INVENTION

1. Field of the Invention

The present invention is directed to an article of footwear having an undulating sole.

2. Background Art

Individuals are often concerned with the amount of cushioning an article of footwear provides, as well as the aesthetic appeal of the article of footwear. This is true for articles of footwear worn for non-performance activities, such as a leisurely stroll, and for performance activities, such as running, because throughout the course of an average day, the feet and legs of an individual are subjected to substantial impact forces. Running, jumping, walking, and even standing exert forces upon the feet and legs of an individual which can lead to soreness, fatigue, and injury.

The human foot is a complex and remarkable piece of machinery, capable of withstanding and dissipating many impact forces. The natural padding of fat at the heel and forefoot, as well as the flexibility of the arch, help to cushion the foot. Although the human foot possesses natural cushioning and rebounding characteristics, the foot alone is incapable of effectively overcoming many of the forces encountered during every day activity. Unless an individual is wearing shoes which provide proper cushioning and support, the soreness and fatigue associated with every day activity is more acute, and its onset accelerated. The discomfort for the wearer that results may diminish the incentive for further activity. Equally important, inadequately cushioned footwear can lead to injuries such as blisters; muscle, tendon and ligament damage; and bone stress fractures. Improper footwear can also lead to other ailments, including back pain.

Proper footwear should complement the natural functionality of the foot, in part, by incorporating a sole (typically including an outsole, midsole and insole) which absorbs shocks. Therefore, a continuing need exists for innovations in providing cushioning to articles of footwear.

BRIEF SUMMARY OF THE INVENTION

In one embodiment, an article of footwear includes an undulating foam sole. The undulating foam sole includes a plurality of spaced apart peaks, wherein at least one pair of adjacent peaks define a gap void of material between adjacent peaks, and a plurality of spaced apart troughs, wherein at least one trough is adapted to engage the ground and wherein at least one pair of adjacent troughs define a gap void of material between adjacent troughs.

In another embodiment, an article of footwear includes an undulating foam midsole. The undulating midsole includes a first side, a second side, a plurality of spaced apart peaks extending along a width of the midsole between the first and second sides, and a plurality of spaced apart troughs extending along a width of the midsole between the first and second sides. At least one pair of adjacent peaks define a gap void of material between the adjacent peaks that extends along the width of the midsole with one end at the first side and another end at the second side. At least one pair of adjacent troughs define a gap void of material between the adjacent troughs that extends along the width of the midsole with one end at the first side and another end at the second side.

In a further embodiment, an article of footwear includes an undulating midsole and a plate. The undulating midsole includes a first side, a second side, a plurality of spaced apart peaks extending along a width of the midsole between the first and second sides, and a plurality of spaced apart troughs extending along a width of the midsole between the first and second sides. The plate is attached to the plurality of spaced apart peaks. Each of the plurality of spaced apart peaks has a greater height at the first and second sides of the midsole than in an area between the first and second sides.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

Figure 6:
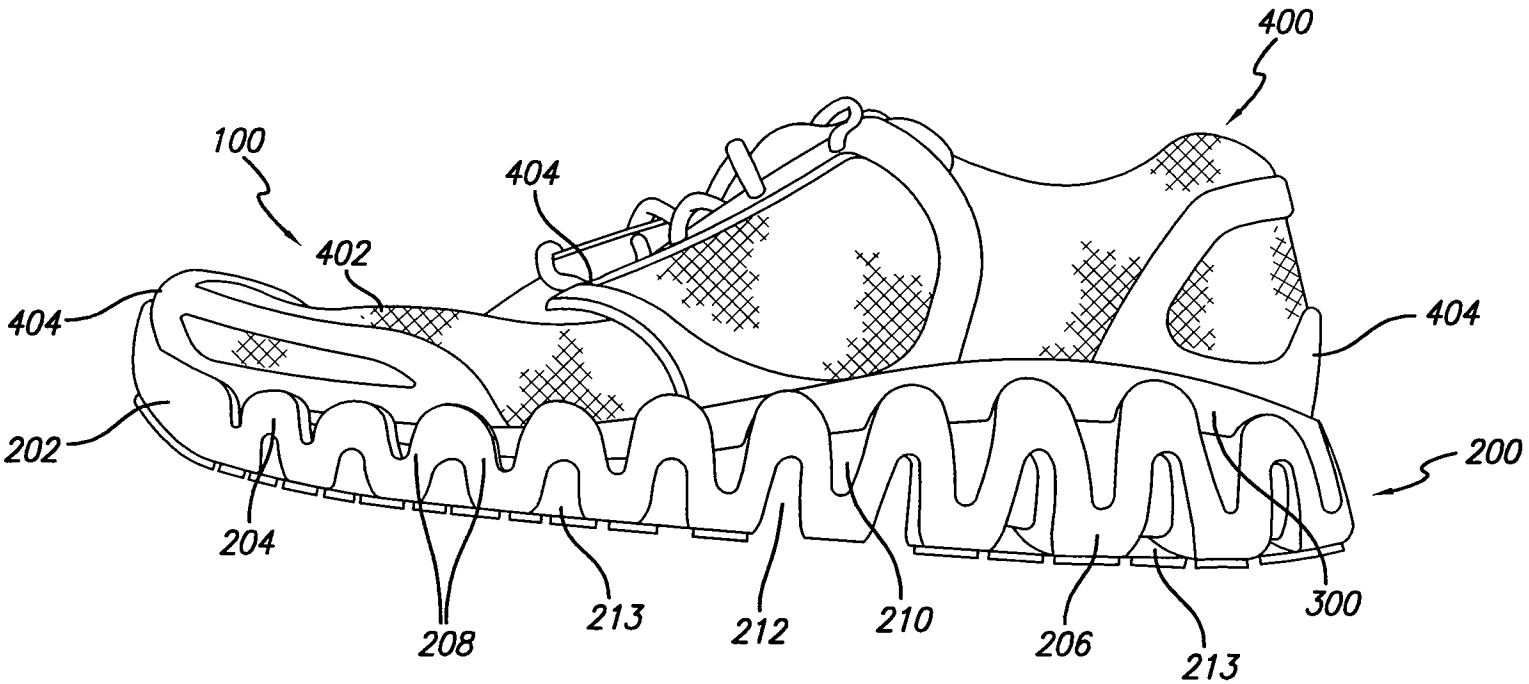
FIG. 6 is a side view of another exemplary article of footwear according to an embodiment of the present invention.
Figure 7:
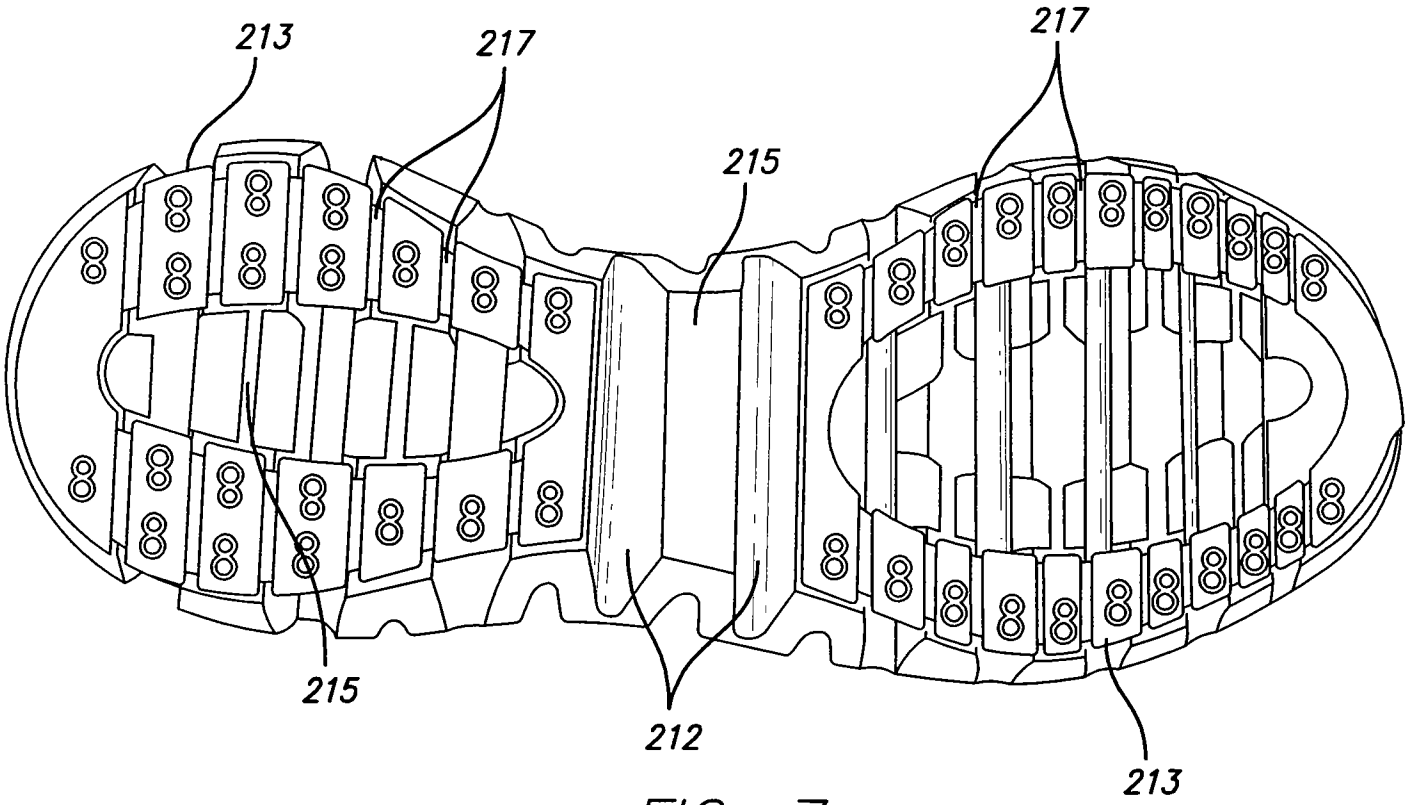
Figure 8:
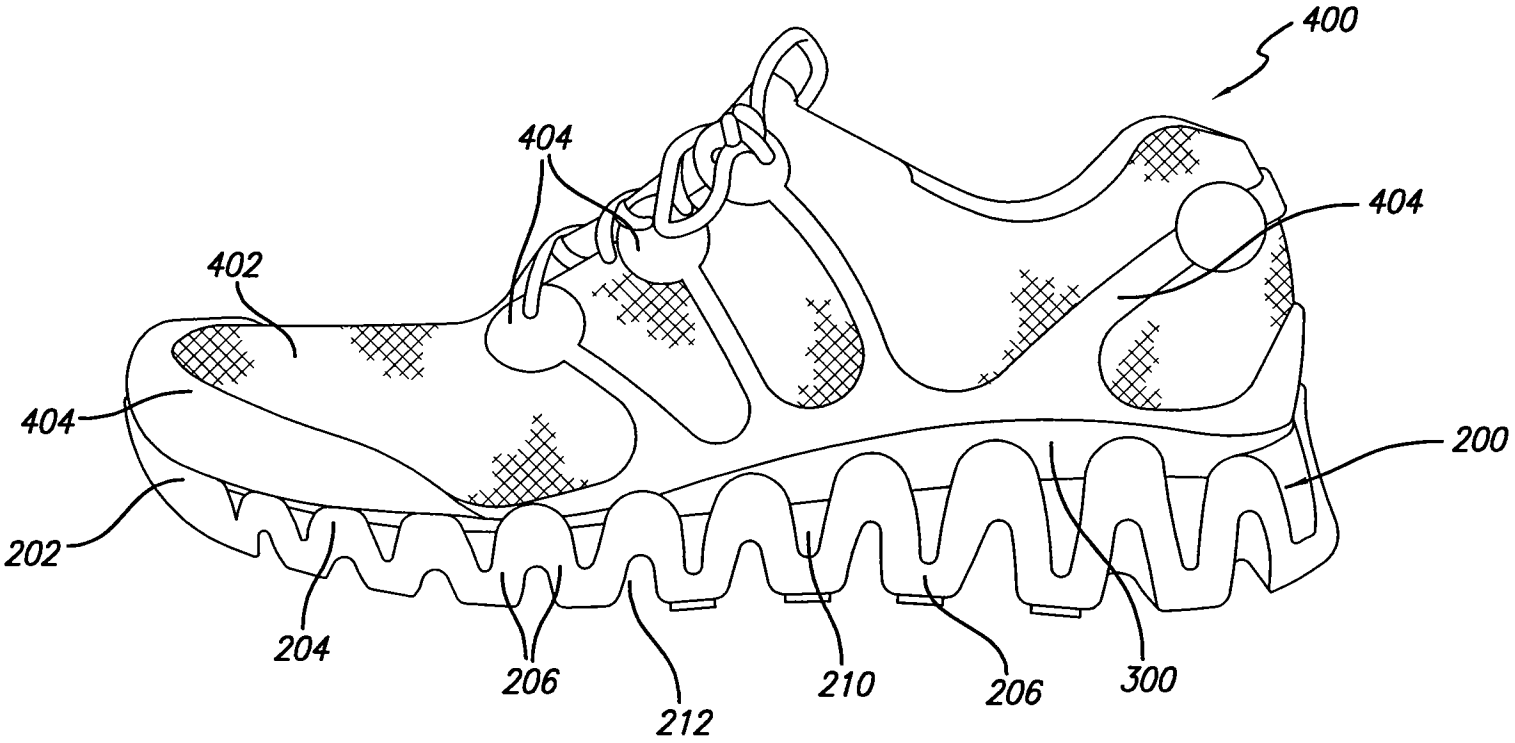
Figure 9:
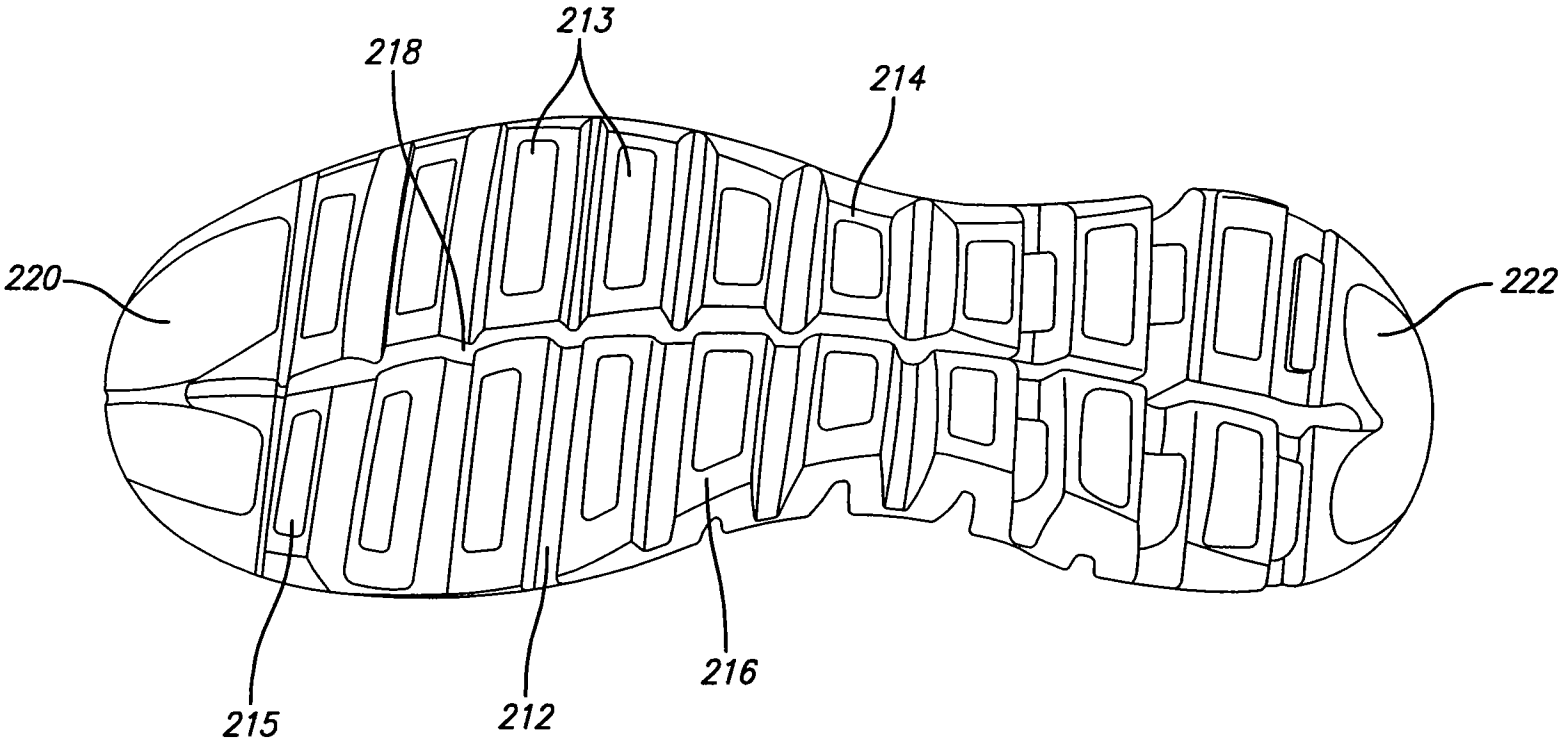
Figure 10:
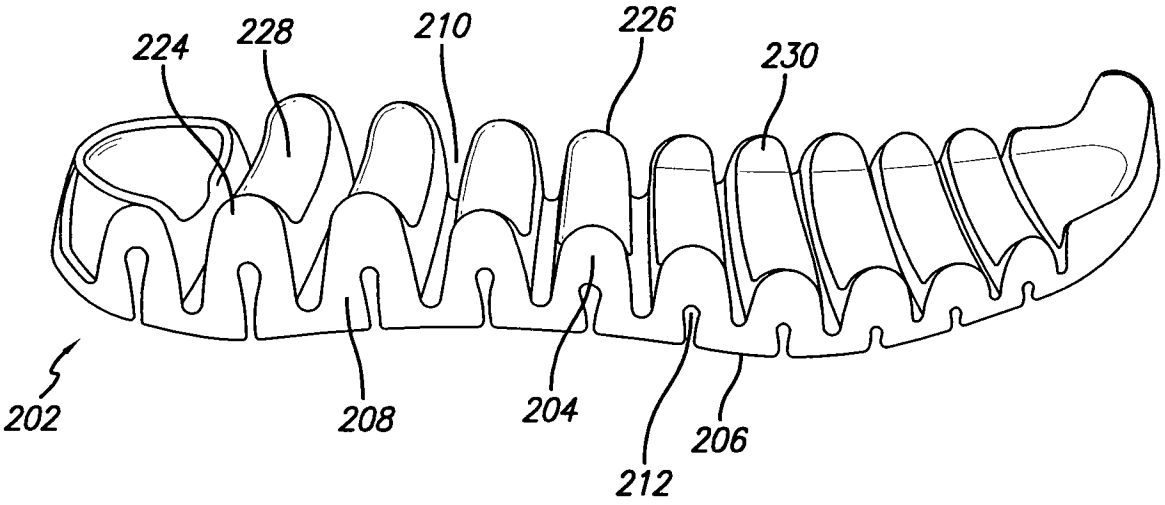
Figure 11:
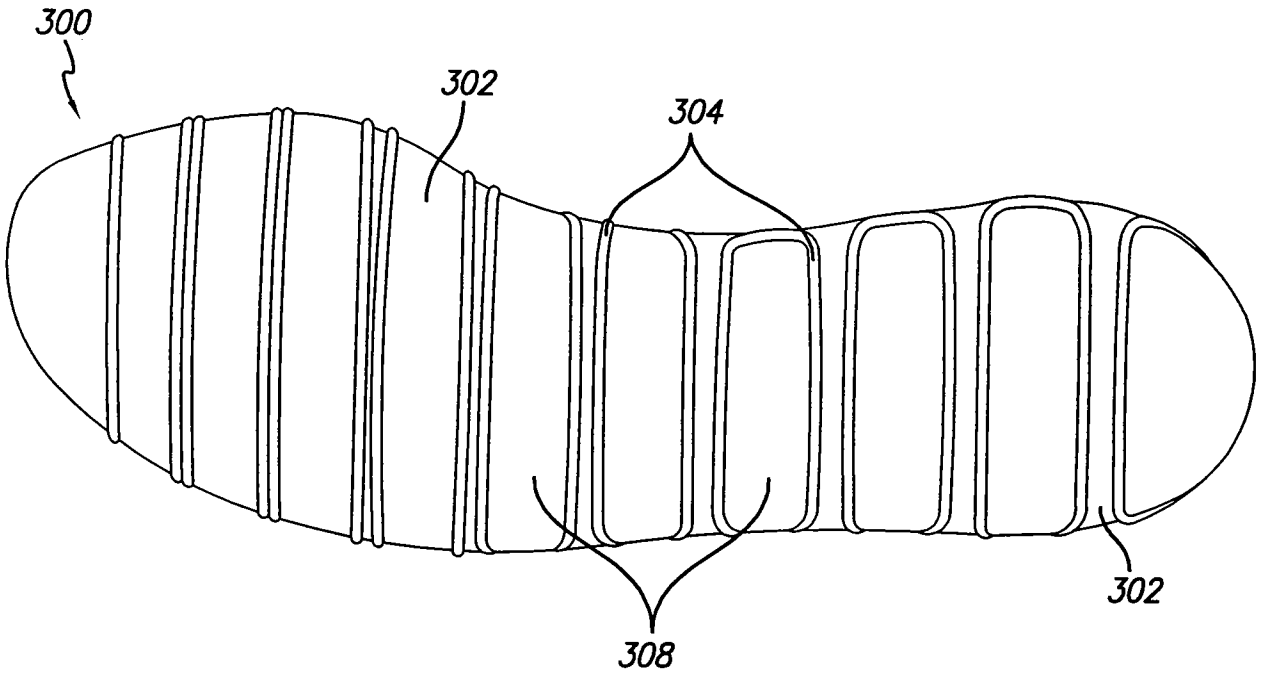
Figure 12:
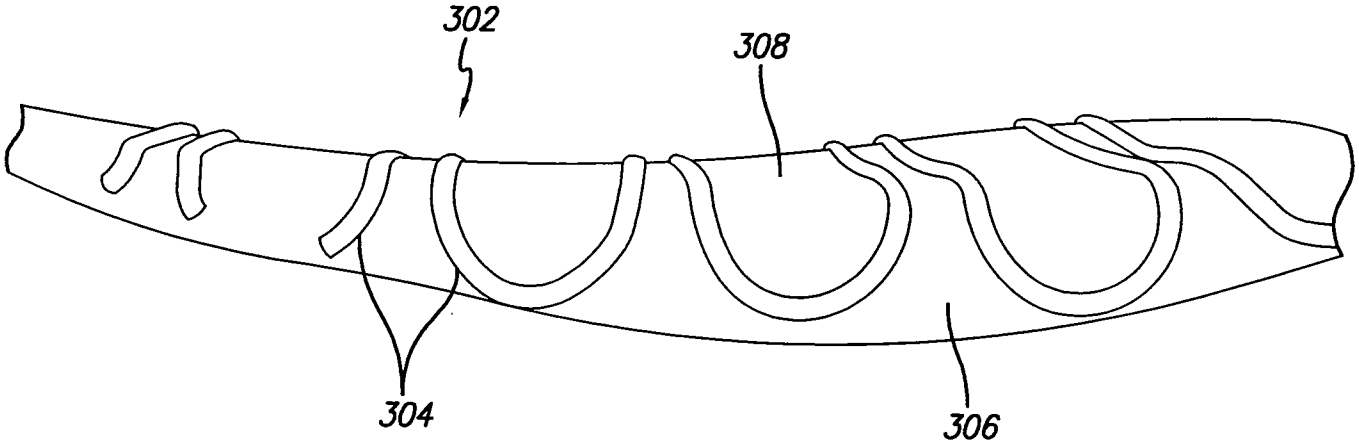

FIG. 7 a bottom view of the exemplary article of footwear of FIG. 6 according to an embodiment of the present invention;

FIG. 8 is a side view of another exemplary article of footwear according to an embodiment of the present invention;

FIG. 9 is a bottom view of the exemplary article of footwear of FIG. 8 according to an embodiment of the present invention;

FIG. 10 is a side view of an exemplary midsole according to an embodiment of the present invention;

FIG. 11 is a bottom view of an exemplary foot plate according to an embodiment of the present invention; and FIG. 12 is a partial side view of the exemplary foot plate of FIG. 11 according to an embodiment of the present invention.

Figure 13:
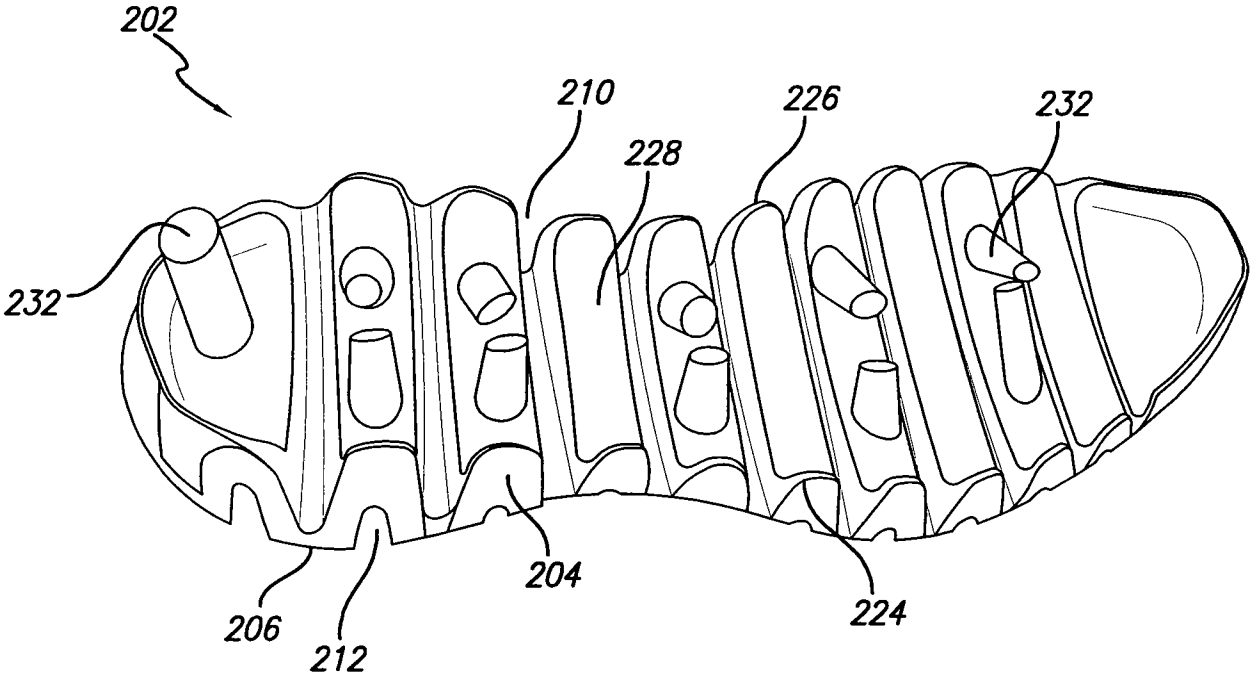

FIG. 13 is a schematic view of an exemplary article of footwear during manufacturing according to an embodiment of the present invention.

Figure 14:
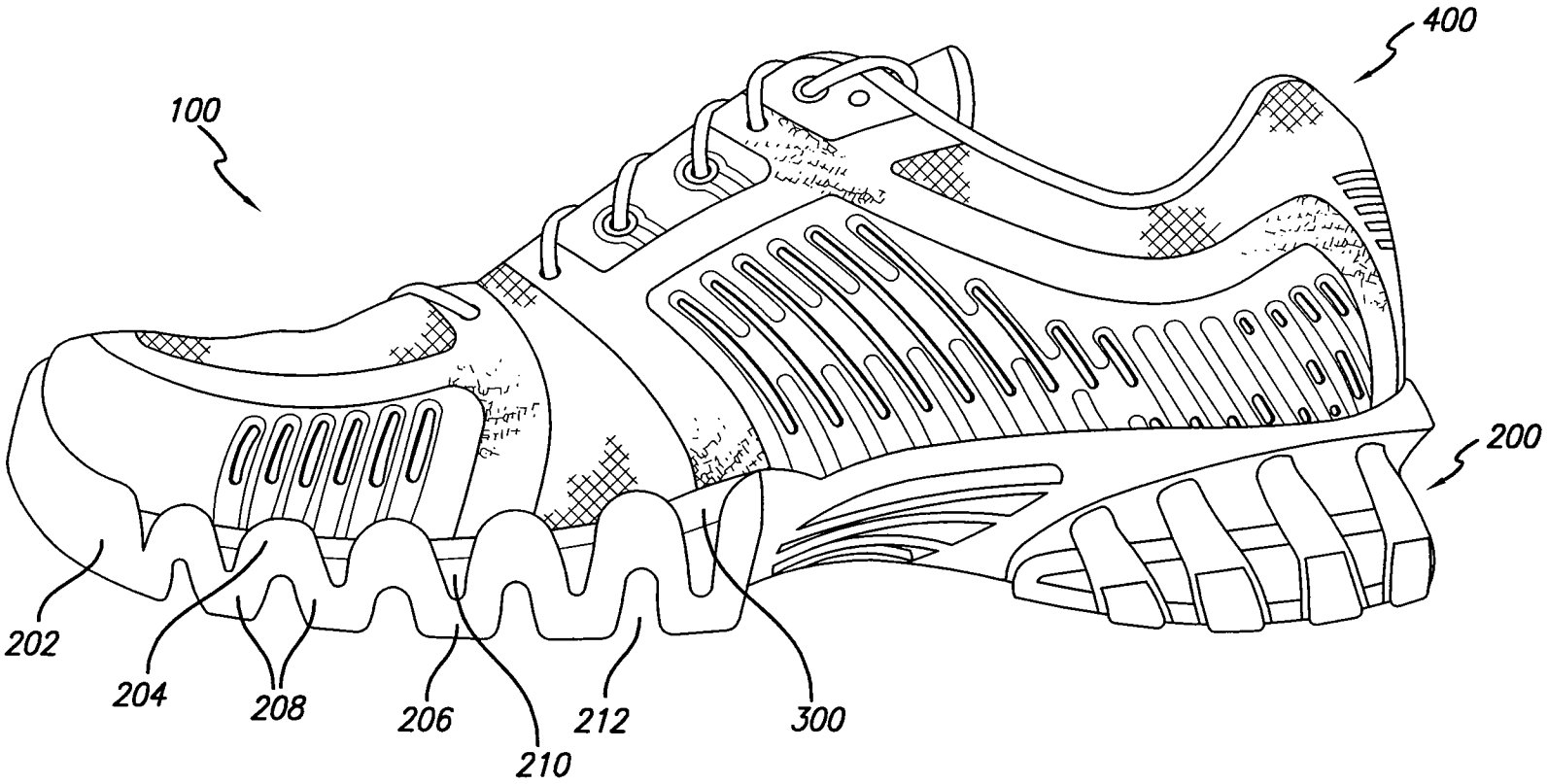

FIG. 14 is a side view of an exemplary article of footwear according to an embodiment of the present invention.

Figure 15:
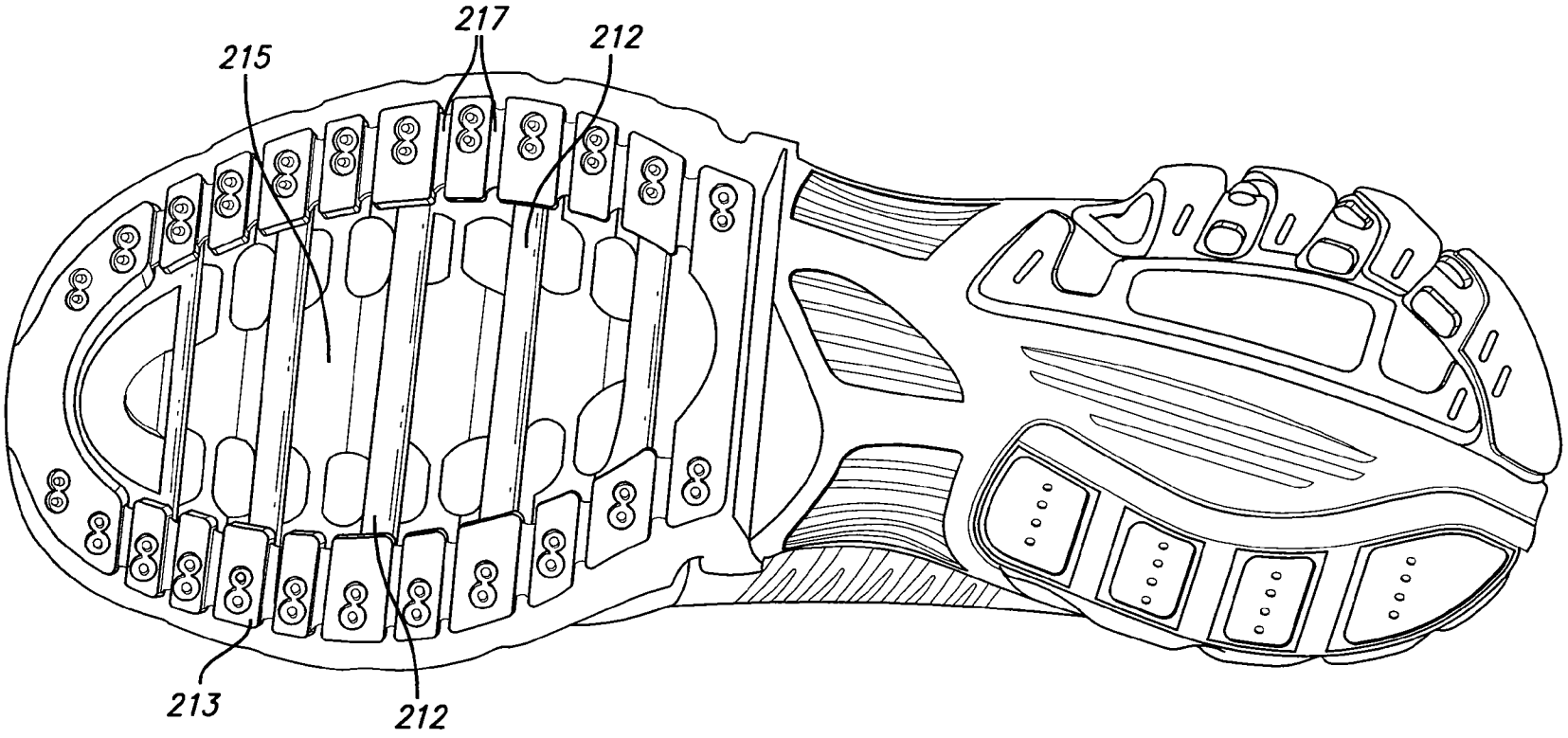

FIG. 15 is a bottom view of the exemplary article of footwear of FIG. 14 according to an embodiment of the present invention.

Figure 16:
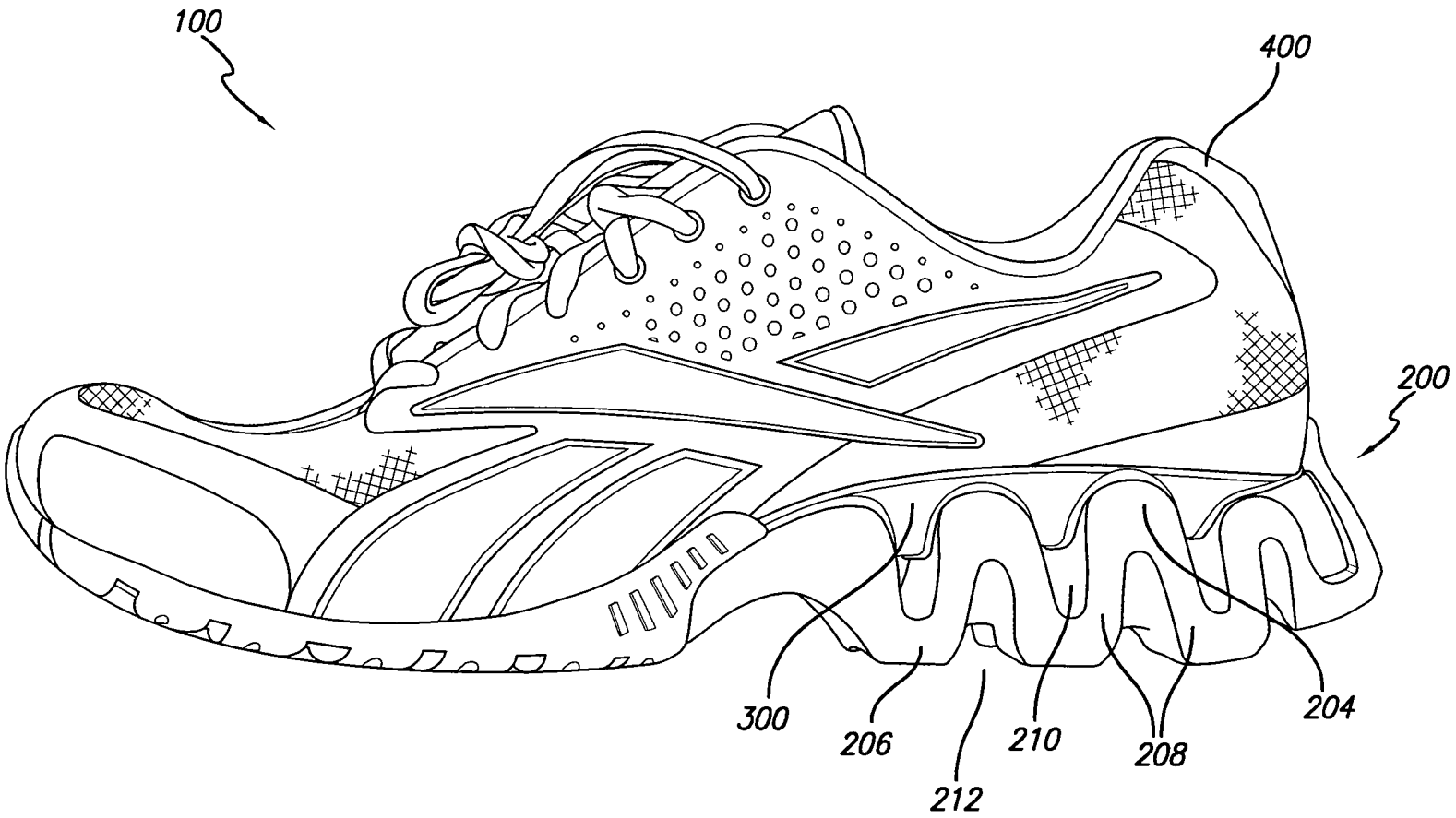

FIG. 16 is a side view of an exemplary article of footwear according to an embodiment of the present invention.

Figure 17:
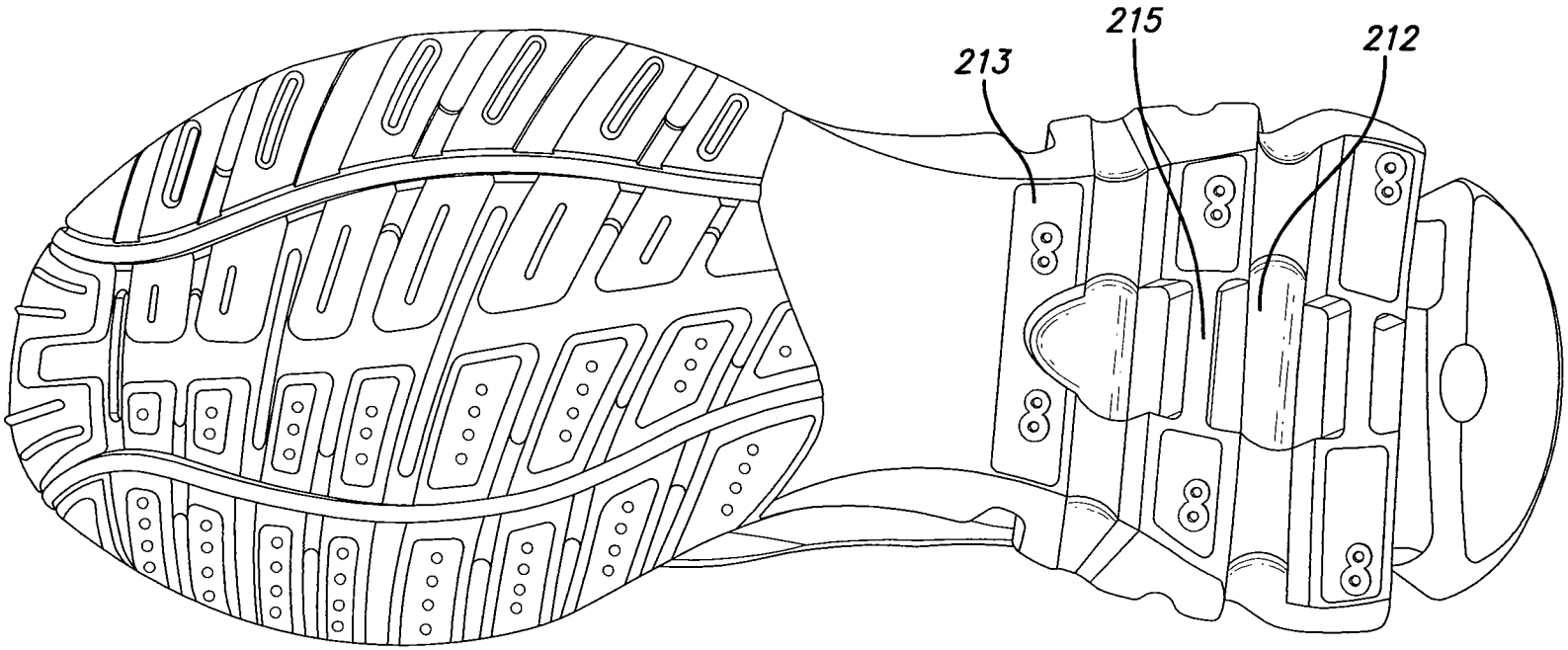

FIG. 17 is a bottom view of the exemplary article of footwear of FIG. 16 according to an embodiment of the present invention.

Figure 18:
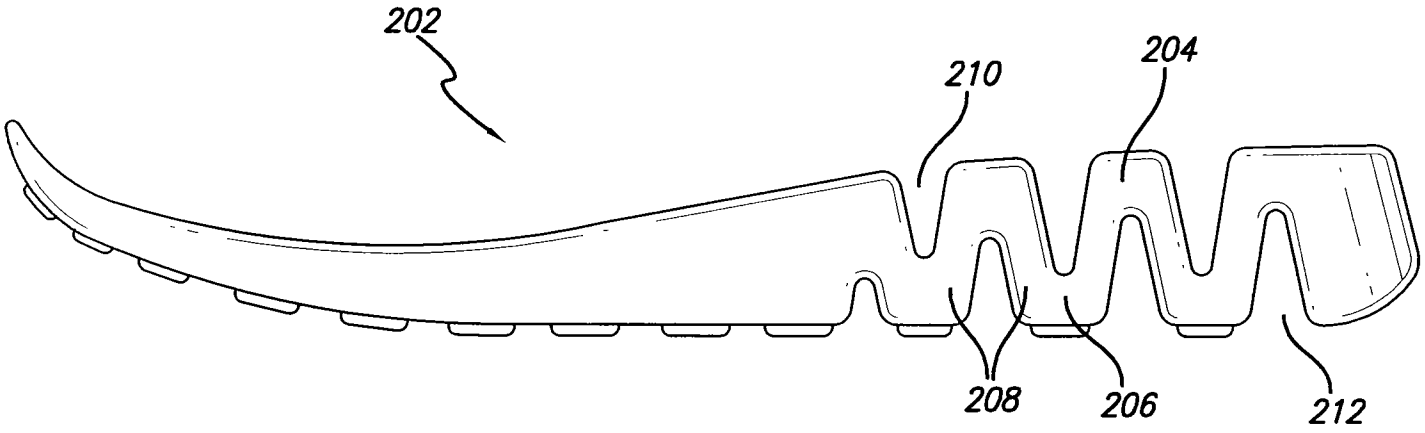

FIG. 18 is a side view of an exemplary midsole for use in the exemplary article of footwear of FIG. 16 according to an embodiment of the present invention.

Figure 19:
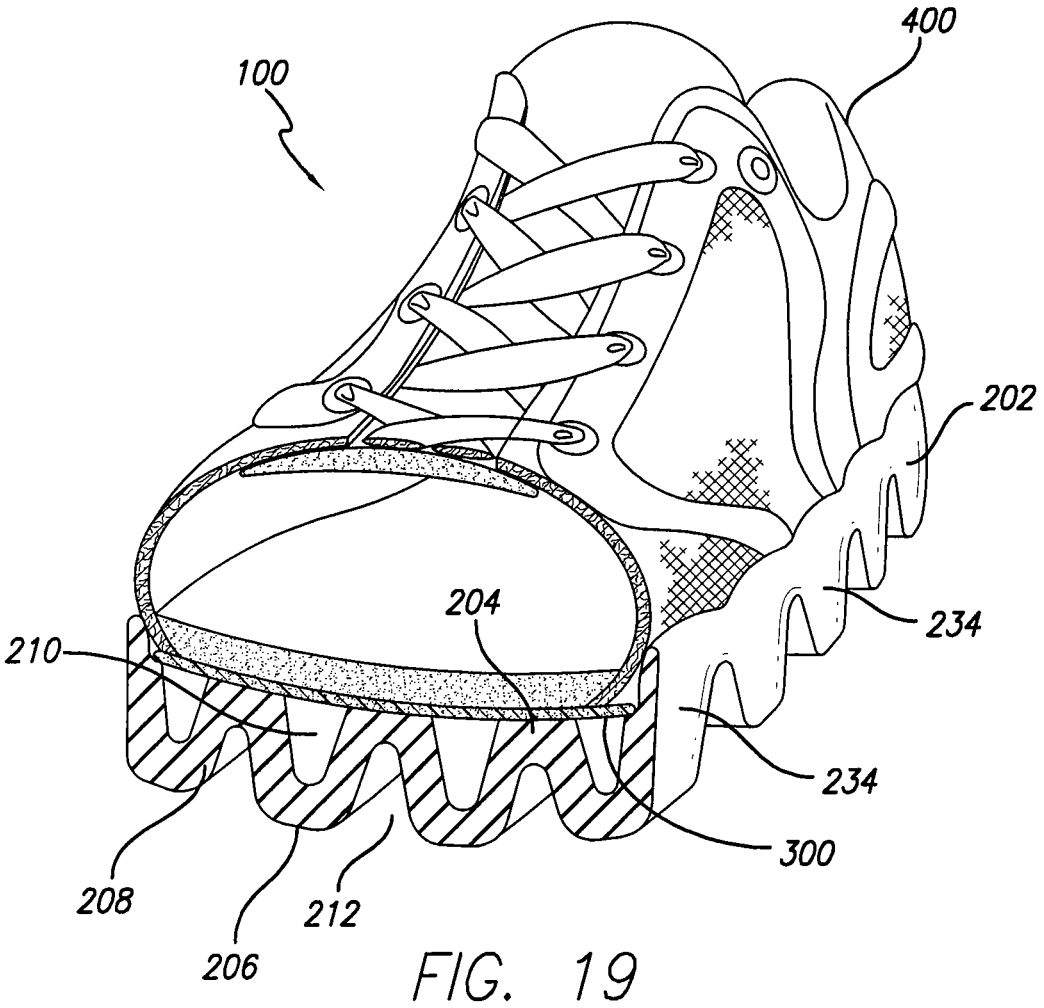

FIG. 19 is front perspective cross-sectional view of an exemplary article of footwear according to an embodiment of the present invention.

DETAILED DESCRIPTION OF THE INVENTION

The present invention is now described with reference to the Figures, in which like reference numerals are used to indicate identical or functionally similar elements. While specific configurations and arrangements are discussed, it should be understood that this is done for illustrative purposes only. A person skilled in the pertinent art will recognize that other configurations and arrangements can be used without departing from the spirit and scope of the present invention. It will be apparent to a person skilled in the pertinent art that this invention can also be employed in a variety of other applications.

An article of footwear 100 according to an embodiment of the present invention may have a sole 200 that undulates to provide a different and unique ride and/or feel to article of footwear 100 while also providing a unique aesthetic appeal and providing training for the wearer's muscles in the legs, lower back, and/or abdomen. A foot plate 300 is attached to undulating sole 200 and an upper 400 is attached to foot plate 300.

Sole 200 may include a midsole 202 having an undulating shape with alternating peaks 204 and troughs 206. In some embodiments, the undulating shape of midsole 202 may be substantially sinusoidal, whereby one or more of the peaks and/or troughs may be rounded. In other embodiments, the undulating shape of midsole 202 may be zigzagged, whereby one or more of the peaks and/or troughs may be pointed. In some embodiments, peaks 204 may be located substantially equidistant between adjacent troughs 206, and similarly, troughs 206 may be located substantially equidistant between adjacent peaks. Between each peak 204 and each trough 206 may be a wall 208. Gaps 210 devoid of material may be present between adjacent peaks 204 and above a trough 206 and gaps 212 devoid of material may be present between adjacent troughs 206 and below a peak 204. Gaps 210 and gaps 212 may extend across an entire width of midsole 202. In an alternative embodiment, gaps 210 and gaps 212 may extend only along a portion of midsole 202. In one embodiment, the undulating shape of midsole 202 may be substantially similar to a sine wave. A distance between adjacent peaks 204 or adjacent troughs 206 may be substantially similar or may be varied along a length of midsole 202 or combinations thereof.

Midsole 202 may be designed such that each trough 206 contacts or engages the ground separately when a user is walking, running, or otherwise moving under his/her own power. As each trough 206 contacts or engages the ground a compressive force is exerted causing distortion of the shape of gap 210 located above trough 206 as a result of vertical buckling of walls 208 connected to trough 206. The compressive forces can also distort the shape of gaps 212 on either side of trough 206 to increase the distance between the trough 206 contacting or engaging the ground and those adjacent to it. Shear forces exerted on midsole 202 may have the same effect of buckling walls 208 and distorting the shape of gaps 210 and 212.

Accordingly, material for midsole 202 must be sufficiently flexible to allow the buckling and distortions described above so as to provide adequate cushioning. Suitable material for midsole 202 may include, but is not limited to, foam and thermoplastic polyurethane. When midsole 202 is a foam, the foam may be, for example, ethyl vinyl acetate (EVA) based or polyurethane (PU) based and the foam may be an open-cell foam or a closed-cell foam. In other embodiments, midsole 202 may be elastomers, thermoplastic elastomers (TPE), foam-like plastic (e.g., Pebax® foam or Hytrel® foam) and gel-like plastics.

Individually or in combination, the aspects of midsole 202 that uniquely absorb the compressive and shear forces may include the: (1) tall, thin shape of walls 208, (2) angles between adjacent walls 208 of undulating midsole 202, (3) gaps 210 and 212 void of material on either side of walls 208; and/or (4) compression of the foam itself (aside from distortion of the sole geometry). Buckling may occur due to tall, thin walls 208. The voids of material or gaps 210, 212 may allow for the buckling and/or distention of the material of midsole 202 to occur when loaded. The contact of midsole 202 on the ground in the midfoot region may provide a new ride to the shoe. The heel strike may take a prolonged amount of time compared to a typical running shoe, which can decrease the peak forces. When a force is applied to the midsole, not only does the midsole material compress, but the physical shape of the midsole may also change to absorb the compressive and shear forces. The physical changes in shape, and/or the buckling, which may include walls 208 distending into one of the voids of material or gaps 210, 212 on either side of the wall, may occur because of the tall, thin shape of walls 212, angles between walls 208 of the undulating midsole 202, and/or voids of material or gaps 210, 212 on either side of walls 208. The unique shape, midsole contact with the ground in the midfoot region, and/or material may vary the amount of time spent in each phase of the gait cycle for an individual compared to a more traditional running shoe, possibly decreasing the peak force experienced by that individual.

The above described effects of the compressive forces and shear forces on midsole 202 may cause the wearer's body to work harder. By forcing the wearer's body to work harder, the shoe may trigger increased training to the muscles, such as those muscles in the wearer's calves, thighs, lower back, buttocks, and/or abdomen. As a result of this extra work, when a wearer travels a given distance, the affected muscles may feel like they have worked in traversing a distance farther than the given distance, thereby enhancing a wearer's amount of exercise.

Figure 1:
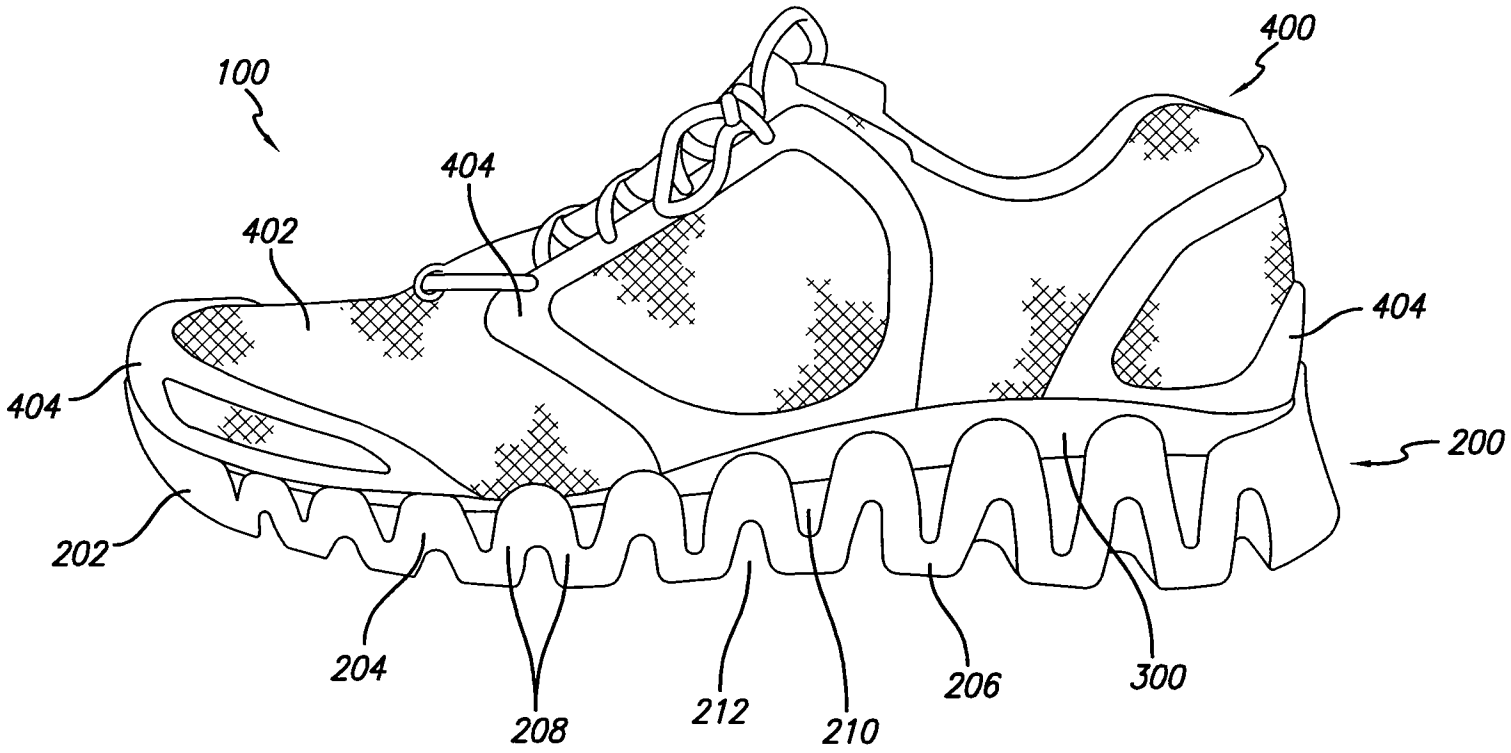
FIG. 1 is a side view of an exemplary article of footwear according to an embodiment of the present invention.

Walls 208 may be contoured to provide gaps 210 and gaps 212 with a variety of shapes in order to impart varying cushioning effects. In one embodiment, as shown for example in FIGS. 1 and 6, gaps 210 may be substantially v-shaped. The angle provided between adjacent walls 208 may be adapted to provide the desired cushioning properties. For example, in one embodiment the angle between adjacent walls 208 may be in the range of from about 10 degrees to about 50 degrees, such as from about 10 degrees to about 40 degrees or about 15 degrees to about 35 degrees. In one embodiment, the angle between adjacent walls may vary along the length of midsole 202. For example, in one embodiment the angle may be greater between one or more pair of adjacent walls 208 in the heel portion of midsole 202 and lesser between one or more pair of adjacent walls 208 in the forefoot portion. For example, in some embodiments the angle between adjacent walls 208 in the forefoot portion may be from about 30 to about 40 degrees. In some embodiments the angle between adjacent walls 208 in the heel portion may be from about 15 to about 25 degrees. In another embodiment, as also shown for example in FIG. 1, gaps 212 may be substantially shaped as an inverted v.

The depth of gaps 210 and 212 may also be varied to provide the desired cushioning properties. In one embodiment, as shown for example in FIG. 1, the depth of gaps 210 may vary along the length of midsole 202. For example, gaps 210 may be deeper in the heel region of midsole 202, and become more shallow toward the forefoot region of midsole 202.

Figure 3:
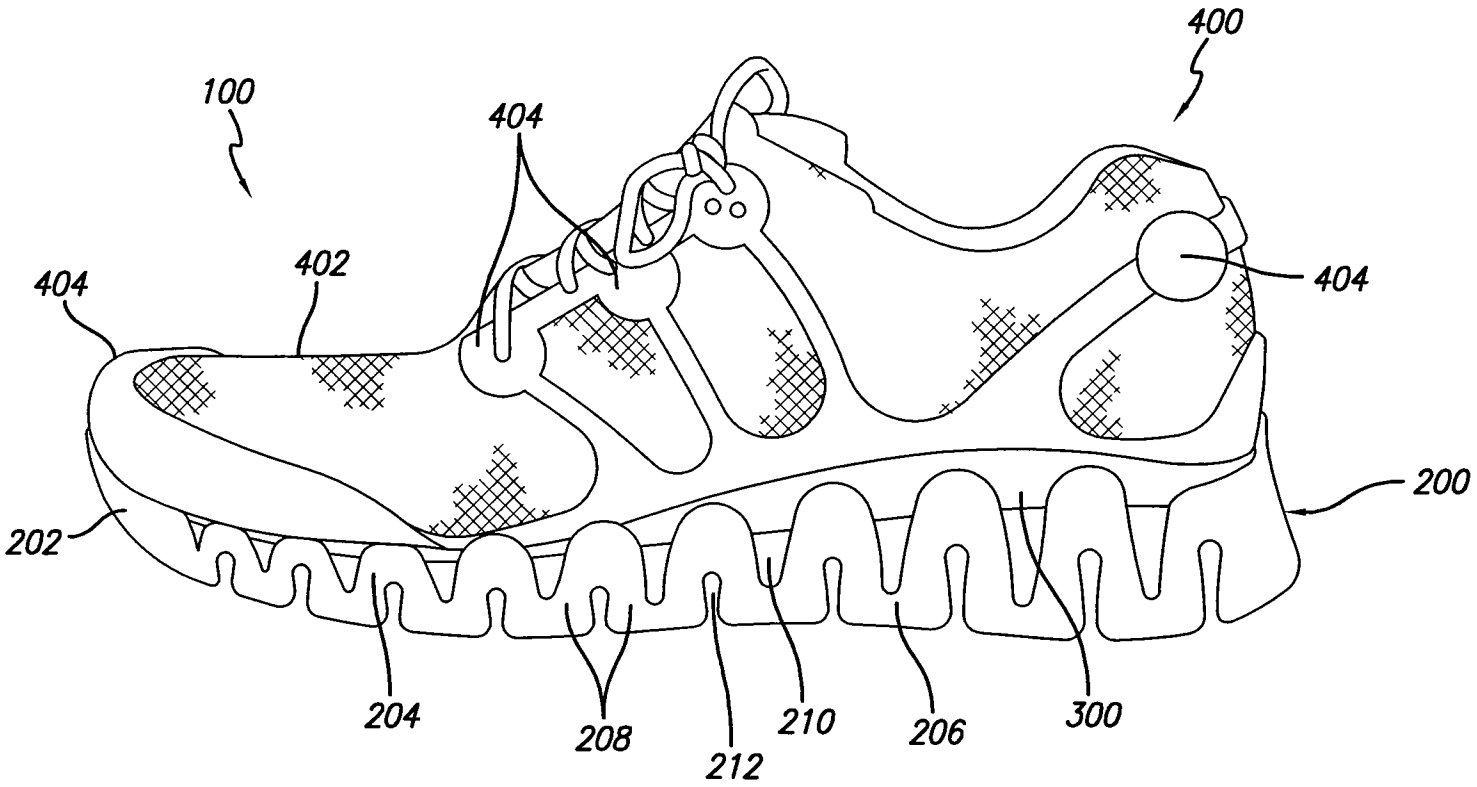
FIG. 3 is a side view of another exemplary article of footwear according to an embodiment of the present invention.
Figure 5:
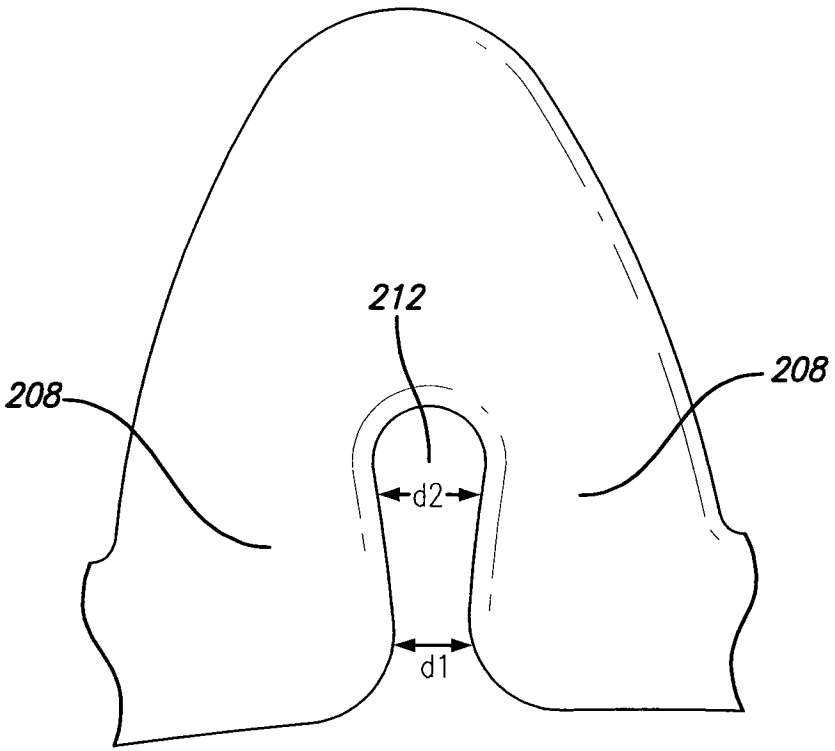
FIG. 5 is a close up side view of a portion of a midsole of the exemplary article of footwear of FIG. 3 according to an embodiment of the present invention.

In another embodiment, as shown for example in FIGS. 3 and 5, gaps 212 may be substantially omega-shaped (Ω) such that each gap 212 has a rounded top section and a narrow bottom section wherein the distance d1 between the surface of the two walls 208 forming and facing each gap 212 is shorter at the bottom of gap 212 than a distance d2 in a middle portion of gap 212. The embodiments described above are merely exemplary and gaps 210 and gaps 212 may have any combination of shapes as would be apparent to one of ordinary skill in the art. For example, in one embodiment midsole 202 may include a combination of v-shaped and omega-shaped gaps.

The number of walls 208, and, correspondingly, the number of gaps 210 and 212 provided in midsole 202 may vary depending upon the desired cushioning characteristics or upon the length and width of midsole 202. In one embodiment, as shown for example in FIG. 1, midsole 202 may include ten gaps 210. The number of gaps 210 and 212 may vary depending upon a thickness of walls 208, a frequency of the undulation, and/or the angle between adjacent walls 208.

One or more troughs 206 of midsole 202 may have an outsole piece 213 attached thereto to provide additional traction. Outsole piece 213 may be rubber or any suitable material typically utilized for an outsole. In one embodiment, as shown for example in FIG. 2, a trough 206 may have one or more outsole pieces 213. In another embodiment, as shown for example in FIG. 4, outsole piece 213 may contact one or more troughs 206 and span a portion of gap 212 between adjacent troughs 206. In another embodiment, as shown for example in FIG. 7, midsole 202 may have an outsole piece 213 that covers a periphery of a heel region of midsole 202 and/or another outsole piece 213 that covers a periphery of a forefoot region of midsole 202. Outsole piece 213 spans gaps 212 between adjacent troughs 206 and may include areas of reduced thickness 217 that allow outsole piece 213 to flex and lengthen when gaps 212 lengthen. Outsole pieces 213 may be made from a suitable polymeric material that permits the above-described lengthening and flexing. The above embodiments are merely exemplary and one skilled in the art would readily appreciate the pattern of outsole piece(s) 213 on trough(s) 206 of midsole 202 may have a variety of configurations. In addition, as shown in FIGS. 2, 4, 7, and 9, a bottom surface 215 of each trough 206 may have a contour that varies across a width of midsole 202. Bottom surface 215 of each trough 206 may have the same contour and/or shape, varying contours and/or shapes and combinations thereof. One skilled in the art would readily appreciate that the shape and pattern of outsole piece(s) 213 may correspond to the contour or shape of bottom surfaces 215 of troughs 206.

Figure 2:
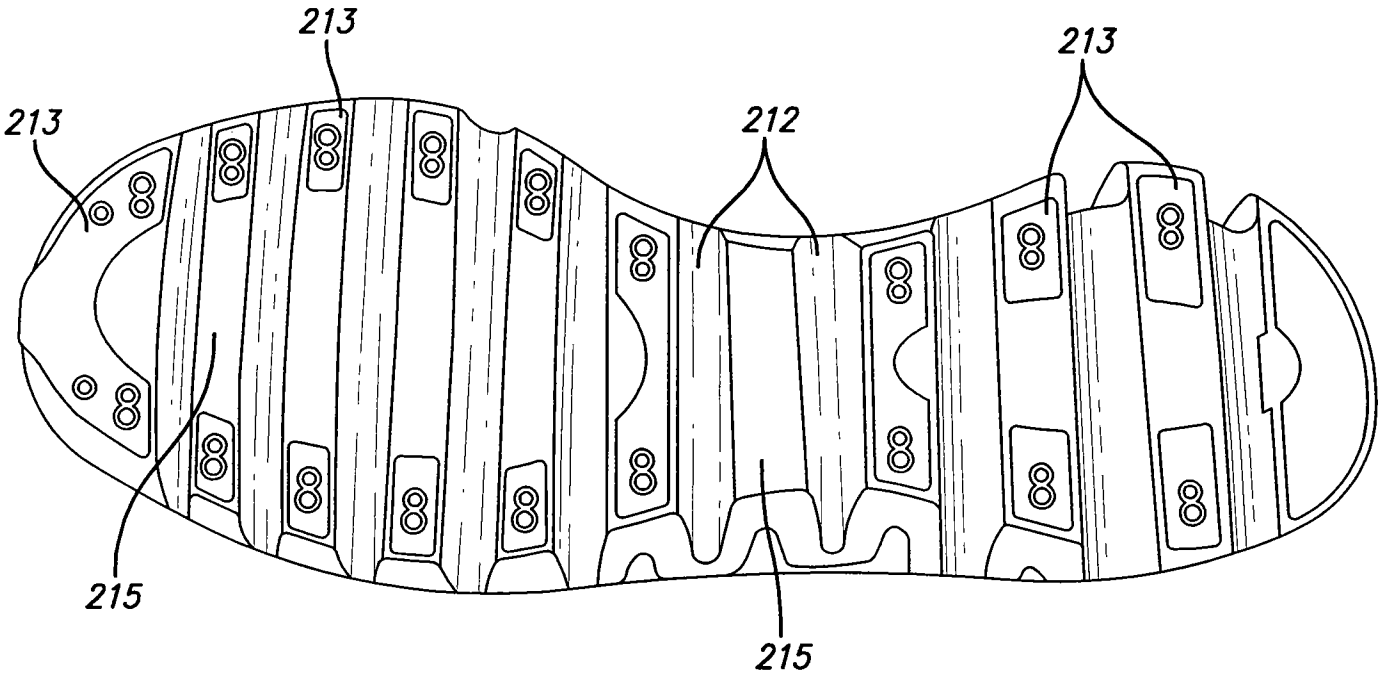
FIG. 2 is bottom view of the exemplary article of footwear of FIG. 1 according to an embodiment of the present invention.
Figure 4:
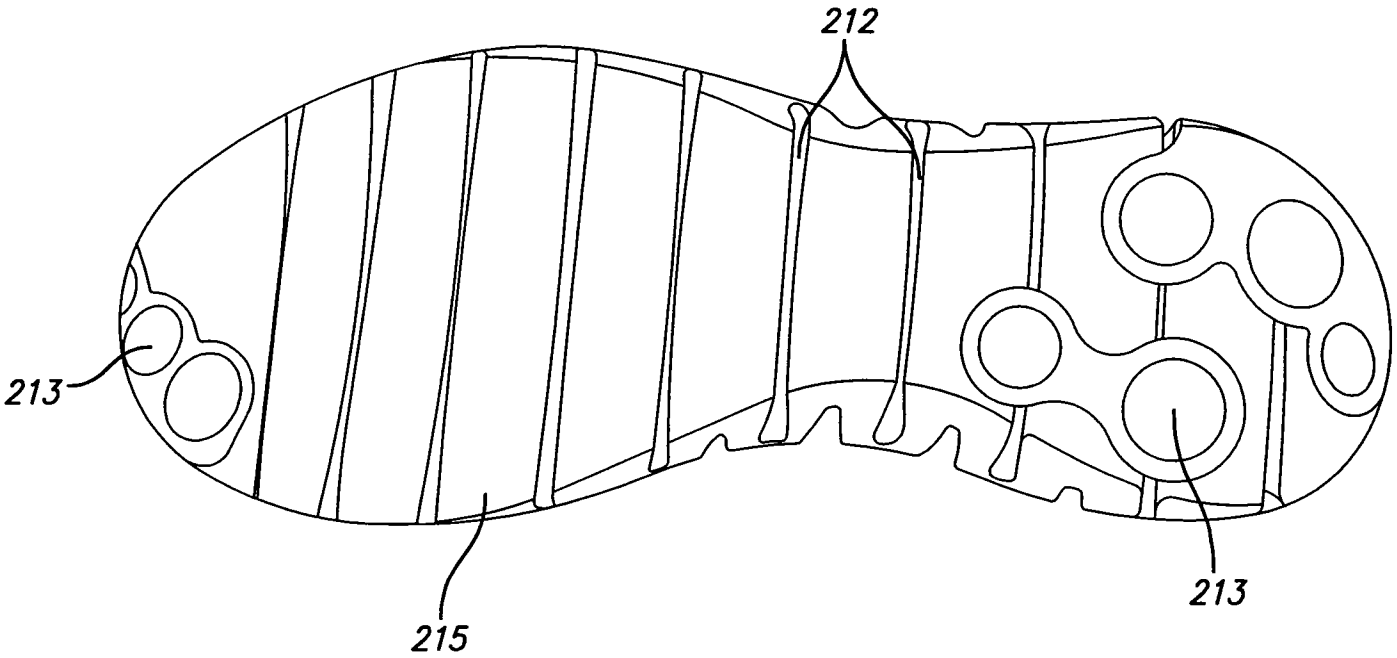
FIG. 4 is a bottom view of the exemplary article of footwear of FIG. 3 according to an embodiment of the present invention.

Midsole 202 may be a single piece, as shown for example in FIGS. 2 and 4, or may comprise two or more pieces. In one embodiment, as shown for example in FIG. 9, midsole 202 may have a lateral midsole piece 214 extending along a lateral side of article of footwear 100 and a medial midsole piece 216 extending along a medial side of article of footwear 100 with a space 218 located between lateral midsole piece 214 and medial midsole piece 216. A forefoot outsole piece 220 may be attached to both lateral midsole piece 214 and medial midsole piece 216 in a manner such that forefoot outsole piece 220 spans and covers a portion of space 218 at the forefoot of article of footwear 100. Similarly, a heel outsole piece 222 may be attached to both lateral midsole piece 214 and medial midsole piece 216 in a manner such that heel outsole piece 222 spans and covers a portion of space 218 at the heel of article of footwear 100. Lateral midsole piece 214 and medial midsole piece 216 may have corresponding undulations such that peaks 204 and troughs 206 of each piece are aligned when assembled in article of footwear 100. Having a separate lateral midsole piece 214 and medial midsole piece 216 may have the advantage of providing a ride or cushioning different from a single piece midsole 202.

As best seen in FIG. 10, midsole 202 may be shaped so that peaks 204 have a greater height at first and second sides 224, 226 of midsole 202 than in an area between first and second sides 224, 226. For example, a top surface 228 of each peak 204 is substantially concave, thereby providing a recess for receiving foot plate 300. In one embodiment, top surface 228 of some peaks 204 may have a groove 230 adjacent first and/or second sides 224, 226 that aids in aligning foot plate 300 in the recess and holding foot plate 300 in place.

Foot plate 300, as best seen in FIGS. 11 and 12, may have a bottom surface 302 with a plurality of ridges 304 extending outward from bottom surface 302. Ridges 304 may be shaped to provide outlines that correspond to the size, shape, and contour of top surfaces 228 of peaks 204 of midsole 202. Ridges 304 may also extend to side surfaces 306 of foot plate 300. Accordingly, ridges 304 aid in aligning foot plate 300 on top surfaces 228 of peaks 204 of midsole 202.

Foot plate 300 may be any suitable thermoplastic material or composite material and, in some embodiments, may be manufactured through molding or lay-up. In other embodiments, foot plate 300 may be a molded foam, such as a compression molded foam, TPU, or Pebax®. In one embodiment, foot plate 300 may be formed separately from midsole 202 and then attached and joined to midsole 202 through adhesive bonding, welding, or other suitable techniques as would be apparent to one of ordinary skill in the art. Areas 308 of bottom surface 302 that contact top surfaces 228 of peaks 204 may be textured to facilitate attachment of foot plate 300 to midsole 202. In another embodiment, foot plate 300 and midsole 202 may be co-molded and thereby formed together simultaneously.

Midsole 202 may be used in conjunction with a variety of uppers 400. In one embodiment, upper 400 may have a bootie 402 for receiving the foot of a wearer attached to an upper surface (not shown) of foot plate 300. In some embodiments, plate 300 may be placed inside shoe 100 and midsole 202 may be attached directly to upper 400. Bootie 402 may be any suitable material that is lightweight and breathable known to those of ordinary skill in the art for use as an upper. Bootie 402 may be attached to the foot plate through adhesive or other conventional attachment techniques. Upper 400 may also have one or more structural members 404 extending from foot plate 300. Structural members 404 provide structure to bootie 402 and may extend along the lateral and medial sides and be utilized in lacing article of footwear 100. Structural members 404 may also be present at a heel area to provide an internal or external heel counter or at a forefoot area to provide an internal or external toe cap. Structural members 404 may be molded from suitable polymeric materials known to those of ordinary skill in the art. Structural members 404 may also have a variety of shapes and sizes as would be apparent to one of ordinary skill in the art.

As will be apparent to those of ordinary skill in the art, midsole 202 may be molded using one or more molds. With reference to FIG. 13, during molding one or more sprue passages may be used to introduce midsole material into the mold. As shown in FIG. 13, in one embodiment of the present invention, eleven (11) sprues may be used to introduce material into the mold, thereby resulting in posts 232, which will be subsequently removed, extending from midsole 202 in the areas corresponding to the sprues. In this manner, the material may be distributed evenly throughout the midsole. In the heel portion of midsole 202, one sprue may be used in the area of the rearmost peak, and two sprues may be used at each of the next two peaks in the heel region. Two sprues may also be used at each of the fifth, seventh, and ninth peaks in midsole 202. In another embodiment, one or more sprues may be used at each of the peaks to introduce the midsole material to the mold. The use of sprues for introducing midsole material into the mold may be useful because sprues may provide for even flow of material; may help to provide proper curing of material; may help to provide even temperature distribution after filling which, in turn, may contribute to consistent skin thickness; may help to make midsoles that are consistent left to right; and may help to make sure the mold is fully filled. Other arrangements for introducing material into the molds during manufacture of midsole 202 may be used. In some embodiments, other methods of molding may be utilized including, but not limited to, compression molding, injection molding, and expansion molding, whereby pellets are placed in a mold and expanded.

During manufacture, because midsole 202 may expand upon removal from its mold, the mold may comprise a smaller size than the desired size of the midsole. For example, in one embodiment of the present invention using EVA material, the mold may comprise about 65% to about 75% of the size of the finished midsole. Depending on the expansion ratio of the material used, other mold sizes may be used.

Midsole 202 may be molded to tailor to various needs such as, for example, to prevent pronation or supination. In such instances, certain areas of midsole 202 may be imparted with different characteristics in order to achieve such customizations. In instances where a medial side of midsole 202 needs to be customized and not a lateral side or vice versa, it may be preferred to utilize a midsole 202 with lateral midsole piece 214 and medial midsole piece 216, as described above. As an alternative to, or in addition to, modifying midsole 202, inserts may be placed between midsole 202 and plate 300 or posts may be utilized to connect midsole 202 to upper 400.

The embodiments of FIGS. 1-4 and 6-10, have illustrated midsole 202 as undulating with peaks 204 and troughs 206 from toe to heel, however this is merely exemplary. In some embodiments, as shown for example in FIGS. 14 and 15, midsole 202 may undulate with peaks 204 and troughs 206 only in a forefoot region. In other embodiments, as shown for example in FIGS. 16-18, midsole 202 may undulate with peaks 204 and troughs 206 only in a heel region. In other embodiments, as shown for example in FIG. 19, midsole 202 may also have one or more rows 334 that undulate with peaks 204 and troughs 206 in a medial to lateral direction. In some embodiments, peaks 204 and troughs 206 of each row 334 may be aligned.

In certain embodiments, undulating sole 200 may be manufactured to provide a different and unique ride and/or feel to article of footwear 100, while also providing a unique aesthetic appeal and improved cushioning and support.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An article of footwear comprising:

an upper;

an undulating foam midsole attached to the upper, the undulating foam midsole comprising:

a plurality of spaced apart peaks extending from a medial side of the midsole to a lateral side of the midsole, wherein at least one pair of directly adjacent peaks of the plurality of peaks define a gap void of material between the at least one pair of directly adjacent peaks, and wherein the plurality of spaced apart peaks have a concave upper surface continuously extending from the medial side to the lateral side of the midsole; and a plurality of spaced apart troughs, wherein a bottom-most surface of at least one trough of the plurality of troughs is adapted to contact the ground and wherein at least one pair of directly adjacent troughs of the plurality of troughs define a gap void of material between a first wall and a second wall of the directly adjacent troughs, wherein a distance of the gap between the first wall and the second wall is narrower at a bottom of the gap than at a middle of the gap; and an outsole piece attached to one or more troughs of the midsole.

2. The article of footwear of claim 1, further comprising a plate attached to the plurality of spaced apart peaks.

3. The article of footwear of claim 1, wherein a shape of each of the plurality of spaced apart troughs is inverse to a shape of a directly adjacent peak of the plurality of peaks.

4. The article of footwear of claim 1, wherein the outsole piece attaches to two troughs and spans the gap between the two troughs.

5. An article of footwear comprising:

an upper;

an undulating foam midsole attached to the upper, the undulating foam midsole comprising:

a medial side;

a lateral side;

a plurality of spaced apart peaks extending along a width of the midsole between the medial and lateral sides, wherein the plurality of spaced apart peaks have a concave upper surface continuously extending from the medial side to the lateral side of the midsole; and a plurality of spaced apart troughs extending along the width of the midsole between the medial and lateral sides, wherein a bottom-most surface of at least one trough of the plurality of troughs is adapted to contact the ground; and an outsole piece attached to one or more troughs of the plurality of troughs of the midsole, wherein at least one pair of directly adjacent peaks of the plurality of peaks define a gap void of material between the directly adjacent peaks, the gap between directly adjacent peaks extending along the width of the midsole with one end of the gap at the medial side and another end of the gap at the lateral side, and wherein at least one pair of directly adjacent troughs of the plurality of troughs define a gap void of material between a first wall and a second wall of the directly adjacent troughs, wherein a distance of the gap between the first wall and the second wall is narrower at a bottom of the gap than at a middle of the gap, the gap between the directly adjacent troughs extending along the width of the midsole with one end of the gap at the medial side and another end of the gap at the lateral side.

6. The article of footwear of claim 5, wherein the plurality of spaced apart peaks are v-shaped.

7. The article of footwear of claim 5, wherein the plurality of spaced apart peaks have a greater height at the medial and lateral sides of the midsole than in an area between the medial and lateral sides.

8. The article of footwear of claim 7, further comprising a plate attached to the plurality of spaced apart peaks, wherein the plate is disposed on each of the plurality of spaced apart peaks in the area between the medial and lateral sides of the midsole.

9. The article of footwear of claim 5, wherein a shape of each of the plurality of spaced apart troughs is inverse to a shape of a directly adjacent peak of the plurality of peaks.

10. The article of footwear of claim 5, wherein the outsole piece attaches to two troughs and spans the gap between the two troughs.

11. An article of footwear comprising:

an upper;

an undulating foam midsole attached to the upper, the undulating foam midsole comprising:

a medial side;

a lateral side;

a plurality of spaced apart peaks extending along a width of the midsole between the medial and lateral sides; and a plurality of spaced apart troughs extending along the width of the midsole between the medial and lateral sides, wherein a bottom-most surface of at least one trough of the plurality of troughs is adapted to contact the ground, wherein a distance between directly adjacent troughs is narrowest between portions of the directly adjacent troughs configured to contact the ground;

a plate attached to the plurality of spaced apart peaks; and an outsole piece attached to one or more troughs of the plurality of troughs of the midsole, wherein the plurality of spaced apart peaks have a greater height at the medial and lateral sides of the midsole than in an area between the medial and lateral sides, and wherein the plurality of spaced apart peaks have a concave upper surface continuously extending from the medial side to the lateral side of the midsole.

12. The article of footwear of claim 11, wherein the plate is disposed on each of the plurality of spaced apart peaks in the area between the medial and lateral sides of the midsole.

13. The article of footwear of claim 11, wherein a shape of each of the plurality of spaced apart troughs is inverse to a shape of a directly adjacent peak of the plurality of peaks.

14. The article of footwear of claim 11, wherein the outsole piece attaches to two troughs and spans a gap between the two troughs.

* * * * *